US006222488B1

(12) United States Patent
Pai-Chuan et al.

(10) Patent No.: US 6,222,488 B1
(45) Date of Patent: Apr. 24, 2001

(54) ANTENNA STRUCTURE FOR COMMUNICATION

(75) Inventors: Chen Pai-Chuan, Taipei; Chang Ho-Chun, Hsinchu, both of (TW)

(73) Assignee: SmartAnt Telecomm Co., Ltd., Hsinchu (TW)

( * ) Notice: Subject to any disclaimer, the term of this patent is extended or adjusted under 35 U.S.C. 154(b) by 0 days.

(21) Appl. No.: 09/517,066

(22) Filed: Mar. 1, 2000

(51) Int. Cl.[7] ..... H01Q 1/38

(52) U.S. Cl. ..... 343/700 MS; 343/846

(58) Field of Search ..... 343/700 MS, 846, 343/829, 830, 833, 834, 848; H01Q 1/38

(56) References Cited

U.S. PATENT DOCUMENTS 5,307,075 * 4/1994 Huynh ..... 343/700 MS
5,801,660 * 9/1998 Ohtsuka et al. ..... 343/700 MS
6,054,953 * 4/2000 Lindmark ..... 343/700 MS

* cited by examiner

*Primary Examiner*—Hoanganh Le
(74) *Attorney, Agent, or Firm*—Birch, Stewart, Kolasch & Birch, LLP

(57) ABSTRACT

The present invention relates to an antenna structure for communication applications, which is used to increase the half-power beamwidth (HPBW) in the H-plane of the slot coupled microstrip patch antenna with a finite size ground plate and a finite size reflector. The antenna combination according to the present invention comprises a front-plate composed of a curved plate, a flat plate, and several patches. By using the present invention, the half-power beamwidth in the H-plane would be increased.

15 Claims, 6 Drawing Sheets

ANTENNA STRUCTURE FOR COMMUNICATION

BACKGROUND OF THE INVENTION

1. Field of the Invention

The present invention relates to an antenna structure for communication, which is especially suitable for a base station (BS) in the radio communication system as a signal transceiver between the base station and mobile terminals to increase the half-power beamwidth in the H-plane.

2. Related Art

Nowadays, the mobile phone has become an essential communication tool in our everyday life and tends to become more popular. The usage of the mobile phone is very similar to that of the conventional telephone. The signal transmission of the mobile phone is duplex so that persons can talk to each other simultaneously. And in order to protect personal privacy, every mobile phone customer has an exclusive phone number and can talk to somebody in coded format via the base station.

Nevertheless, the most popular communication scheme used in the current base stations is the cellular scheme, wherein the high power transmitter for each communication region has been replaced by a lot of low power transmitters, which are also called cells, spreading over the same region. Therefore, in order to cover the communication region throughout and obtain good signal quality, it is necessary to set up a great numbers of cells. And the transmission power, horizontal angular range, and vertical angular range of the base station have also become important parameters to improve the signal quality. If the total amount of antenna can be reduced as low as possible while covering even wider transmission and reception region, the economic profit would be greatly increased.

FIG. 1 shows a three-dimensional structure sketch of a conventional antenna, which comprises:

- a slot coupled a microstrip patch 20, made of a low-loss dielectric flat plate, wherein there is a microstrip 21 on the back plane and a slot 22 on the front plane. The patch is connected to a signal source, which is not shown in this figure, via a conducting line 40;
- a reflector 30, which is a metal plate attached to the back plane of the slot coupled microstrip patch 20 in the manner of electrical isolation so that the backward radiated electromagnetic waves would be reflected forward; and
- an antenna combination 10, placed in front of the slot coupled microstrip patch 20 in the manner of electrical isolation so as to increase the radiation power of the electromagnetic waves. The antenna combination 10 comprises a front-plate 11*a* and a patch 11*b*, which are both connected to the slot coupled microstrip patch 20 in parallel and in the manner of electrical isolation. The areas of the patch 11*b* and the front-plate 11*a* are the same so as to increase the radiation power of the electromagnetic waves.

By using the above antenna structure to transmit signals, the horizontal transmission angle θ will be limited within the range of 60° to 70° from center, or 80° at maximum. Therefore, as far as this rectangular antenna structure is concerned, it is very difficult to satisfy the demand of large signal transmission and wide reception range.

SUMMARY OF THE INVENTION

The primary object of the present invention is to provide an antenna structure for communication, used in a base station of radio communication as a signal transceiver between the base station and several mobile terminals. And the structure is also designed for increasing the half-power beamwidth in the H-plane.

Another object of the present invention is to provide an antenna combination for the base station mentioned above so that the half-power beamwidth in the H-plane can be extended over 90° or even higher.

To achieve the above objectives, the antenna structure according to the present invention comprises a slot coupled microstrip patch for radiating electromagnetic waves and a reflector. The antenna combination is placed in front of the slot coupled microstrip patch in the manner of electrical isolation so as to increase the half-power beamwidth of the radiated electromagnetic waves, and that antenna combination comprises:

- a front-plate, which comprises a first flat plate, a second flat plate, and a curved plate, which is used to connect the first flat plate and the second flat plate. The first flat plate and the second flat plate are placed in the same plane and electrically connected to the curved plate; and
- several patches, parallel to the first flat plate and the second flat plate, and the connection between the front-plate and the patches is electrically isolated. The area of each patch is the same as the projected area of the front-plate onto the patch so as to increase the radiation power of the electromagnetic waves.

If the two-plate antenna structure commonly used in the conventional base station can be replaced by the present antenna combination, the transmission angle would be greatly widened due to the curved plate in the front-plate and the signal transmission/reception region would also be greatly extended.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow by illustration only, and thus is not limitative of the present invention, and wherein.

DETAILED DESCRIPTION OF THE INVENTION

In general, according to different application fields, the design parameters of an antenna includes frequency range, half-power beamwidth (HPBW) in E-plane and H-plane, voltage standing wave ratio (VSWR), connector form, and antenna gain, etc. For a given specification, the antenna structure can be designed to meet the specification by properly modifying values of these design parameters.

Figure 1:
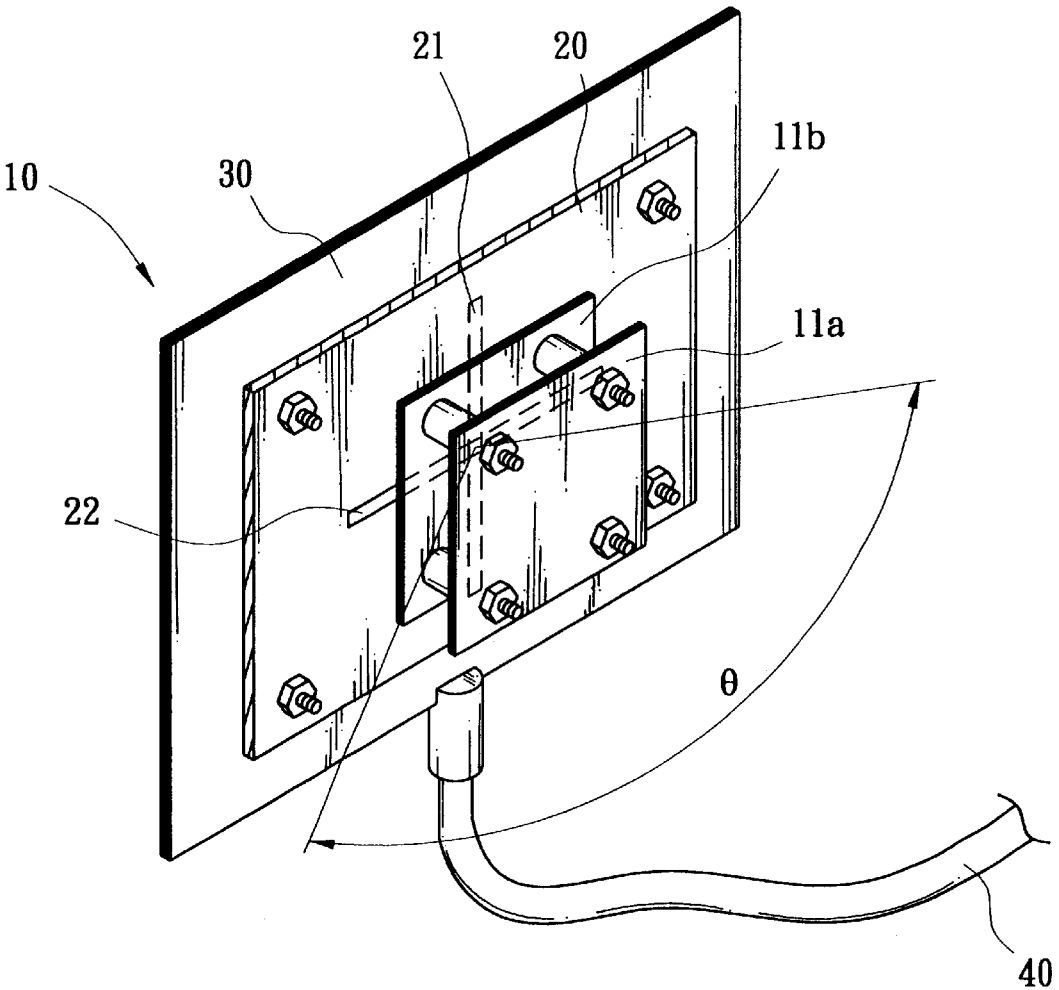
FIG. 1 (PRIOR ART)
FIG. 1 shows a three-dimensional structure of a conventional antenna.

With reference to the three-dimensional structure of the conventional antenna shown in FIG. 1, the half-power beamwidth in the H-plane can be increased by simply reducing the widths of the front-plate 11*a* and the patch 11*b*. But in order to satisfy other requirements simultaneously, such as operation bandwidth, return loss, and antenna gain, etc, the widths of the front-plate 11*a* and the patch 11*b* can not be arbitrarily reduced. Therefore, it is impossible to greatly increase the half-power beamwidth in the H-plane while satisfying other requirements simultaneously by only reducing the widths of the front-plate 11*a* and the patch 11*b*. That is, this method only has limited effects.

Figure 2:
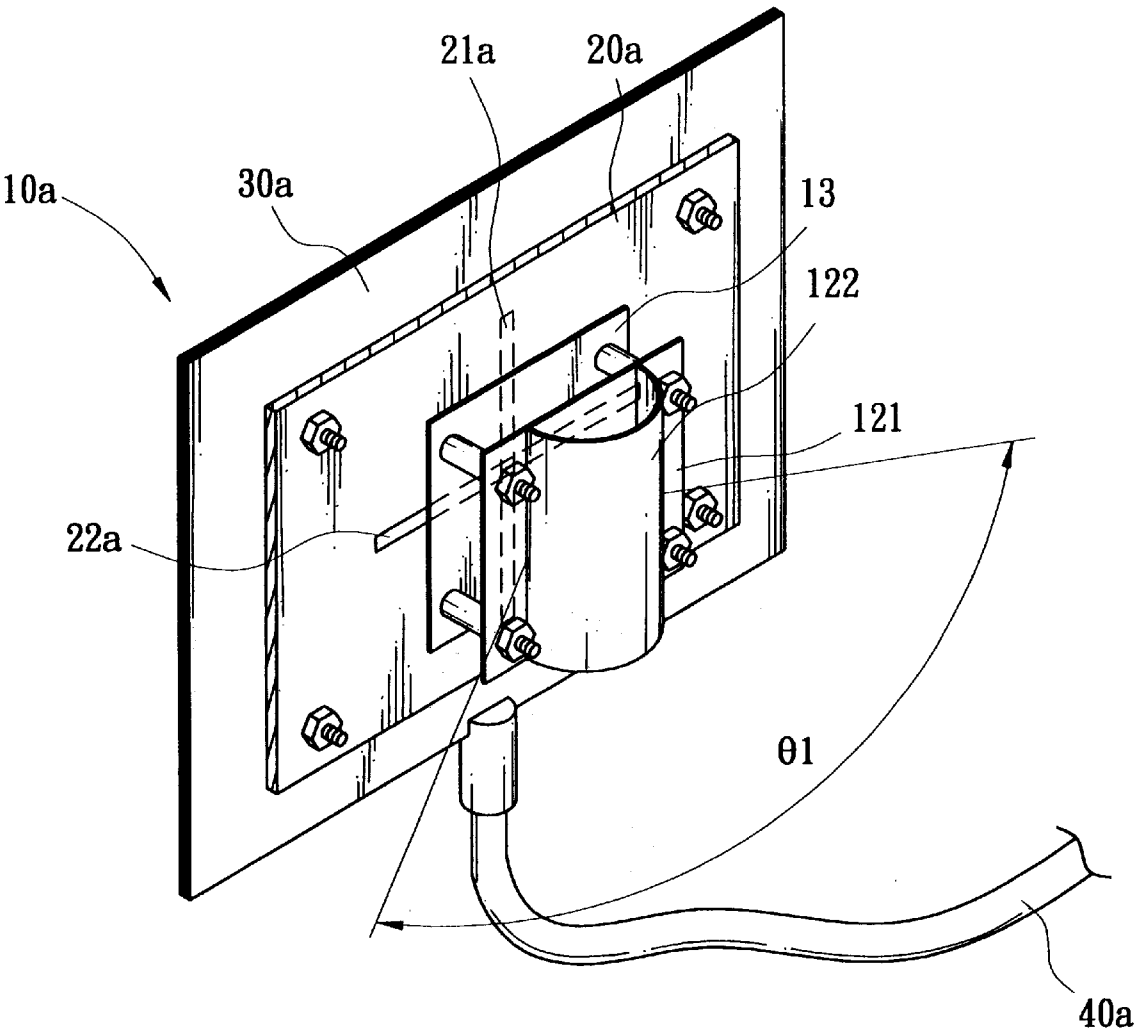
FIG. 2 shows a three-dimensional structure of an embodiment according to the present invention.

First of all, with reference to FIG. 2, which shows a three-dimensional structure of an embodiment of the antenna structure according to the present invention, comprising:

a slot coupled microstrip patch 20*a*, which is a flat plate wherein there are microstrip circuit 21*a* on its back plane and a slot 22*a* on the front plane. This apparatus is connected to a signal source, which is not shown in FIG. 2, via a conducting line 40*a* to radiate electromagnetic waves;

a reflector 30*a*, which may be a metal plate, such as a aluminum plate or iron plate, or a plastic plate covered with a metal film, such as copper film. This apparatus is attached to the back plane of the slot coupled microstrip patch 20*a* in the manner of electrical isolation so as to reflect the backward electromagnetic waves back forward;

an antenna combination 10*a*, which is placed in front of the slot coupled microstrip patch 20*a*. Many sets of antenna combination can be cascaded and then connected to the slot coupled microstrip patch 20*a* in the manner of electrical isolation to increase the half-power beamwidth of the electromagnetic waves. This apparatus comprises a front-plate and at least one patch 13, wherein the front-plate is a director used to radiate the electromagnetic waves and also comprises a curved plate 121 and a flat plate 122. The shape of the curved plate 121 may be semicircle and the flat plate 122 is composed of a first flat plate and a second flat plate, which are placed at the two sides of the curved plate 121 and in the same plane. The curved plate 121 and the flat plate 122 are electrically connected by means of welding; therefore, the solder should be made of electrically conductive materials. The patch 13 is parallel to the flat plate 122 and connected to the front-plate in the manner of electrical isolation. Moreover, the area of the patch 13 is the same as the projected area of the front-plate onto the patch 13 so as to increase the radiation power of the electromagnetic waves. Increasing the amount of the patch can also increase the radiation power of the electromagnetic waves. But, in general, for the sake of cost, only one patch 13 will be used for general case. Furthermore, the curved plate 121, the flat plate 122, and the patch 13 can be made of such materials having good electroconductibility as aluminum or copper.

The working principles of present structure composed of the slot coupled microstrip patch 20*a* and the reflector 30*a* can be briefly described as follows.

1. Microstrip antenna

The microstrip antenna is laid out on a dielectric plate wherein the two endpoints of the microstrip circuit 21*a* are open. One side of the dielectric plate is full of conductors, whereas there are feed lines distributed on the other side. If the area of the conductor is much larger than the width of the feed line, then the conductor will have the same effects as the conductor with infinite area. Therefore, the microstrip between the open endpoints and the slot can then be used to produce image impedance so as to match the impedance of the antenna.

2. Slot Antenna

The slot 22*a* is created on the conductor side of the dielectric plate and used as an antenna. If a high frequency current is fed to the narrow part of the slot 22*a*, then a standing electrical field will be produced and cause a resonance on the slot 22*a*. Therefore, the primary function of the slot 22*a* is to transfer energy to its upper plate, such as the patch 13 of the present invention. This is the working principle of the slot coupled stacked microstrip antenna according to the present invention; and 3. Antenna with the Reflector 30*a*

The simplest way to concentrate the radiation power of electromagnetic waves to a specific direction is to install a reflector 30*a* in the back of the antenna. If the size of the reflector 30*a* is much larger than the wavelength of the electromagnetic waves, then the antenna gain will be larger and directional property will also be improved. Whereas, if the size of the reflector 30*a* is rather small, a portion of electromagnetic waves will radiate backward and thus reduce the antenna gain.

By way of utilizing the above three working principles, the signals from a signal source can then be transmitted outside via the present antenna structure. Moreover, since the beamwidth of the electromagnetic waves transmitted from the flat plate 122 in the antenna combination 10*a* can be increased due to the curved plate 121, the half-power beamwidth in the H-plane θ1 can be extended over 90°. Furthermore, by way of adjusting the shape of the curved plate 121 or the length of the flat plate 122, the half-power beamwidth in the H-plane may be further increased.

Figure 3:
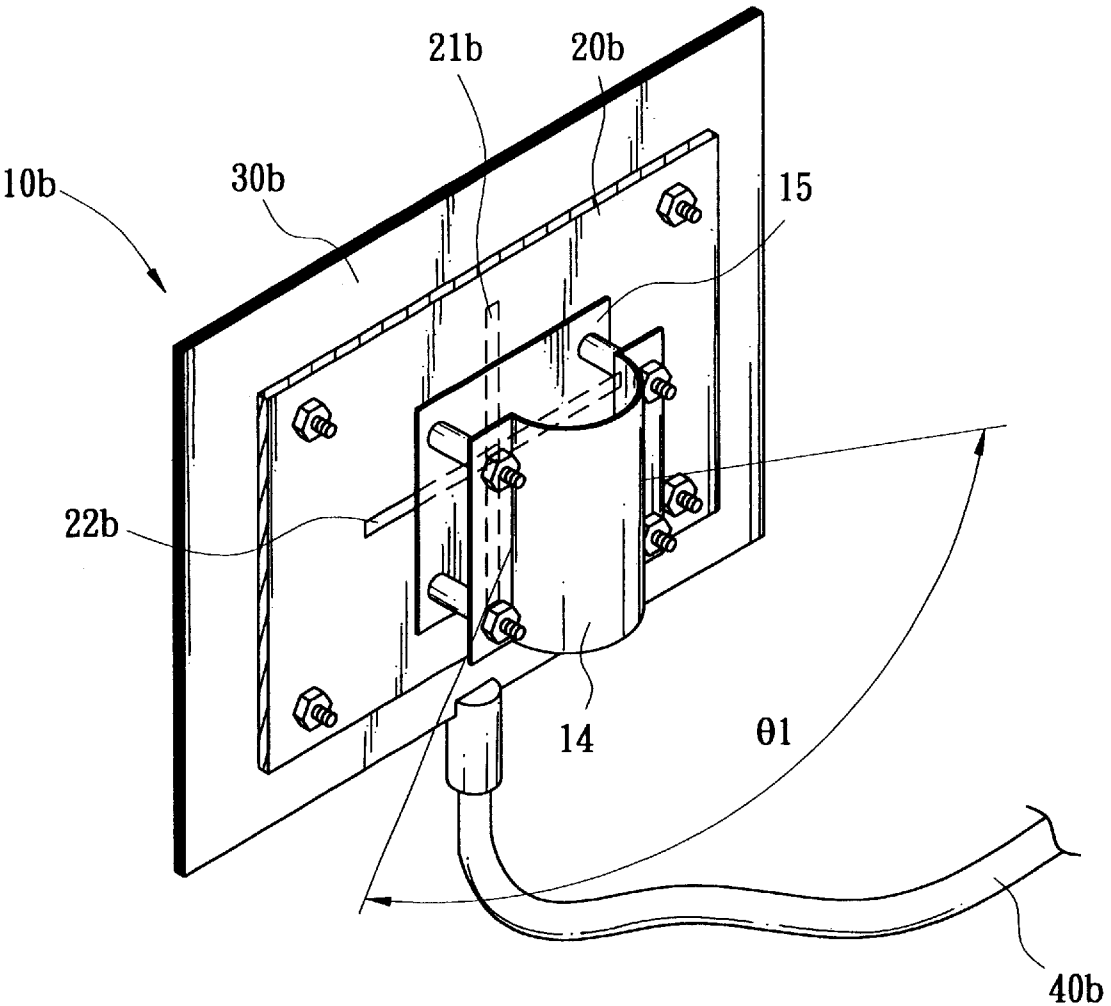
FIG. 3 shows a three-dimensional structure of another embodiment according to the present invention.

With reference to FIG. 3, it shows a three-dimensional structure of another embodiment according to the present invention. The structure is very similar to that of the first embodiment, but there are a few differences in the part of antenna combination 10*b* wherein the front-plate of the antenna combination 10*b* is made of only one piece of plate. That is, the front-plate is bent to be a cambered shape so that the curved plate and the flat plate are made of the same plate. The antenna combination 10*b* is therefore composed of the curved front-plate 14 and the patch 15. The installation and the usage are the same as that of the first embodiment; moreover, the geometrical relationship and the materials used in this structure can also continue using the same conditions described in the first embodiment. By using the above structure, the half-power beamwidth in the H-plane θ1 can also be increased.

Figure 4:
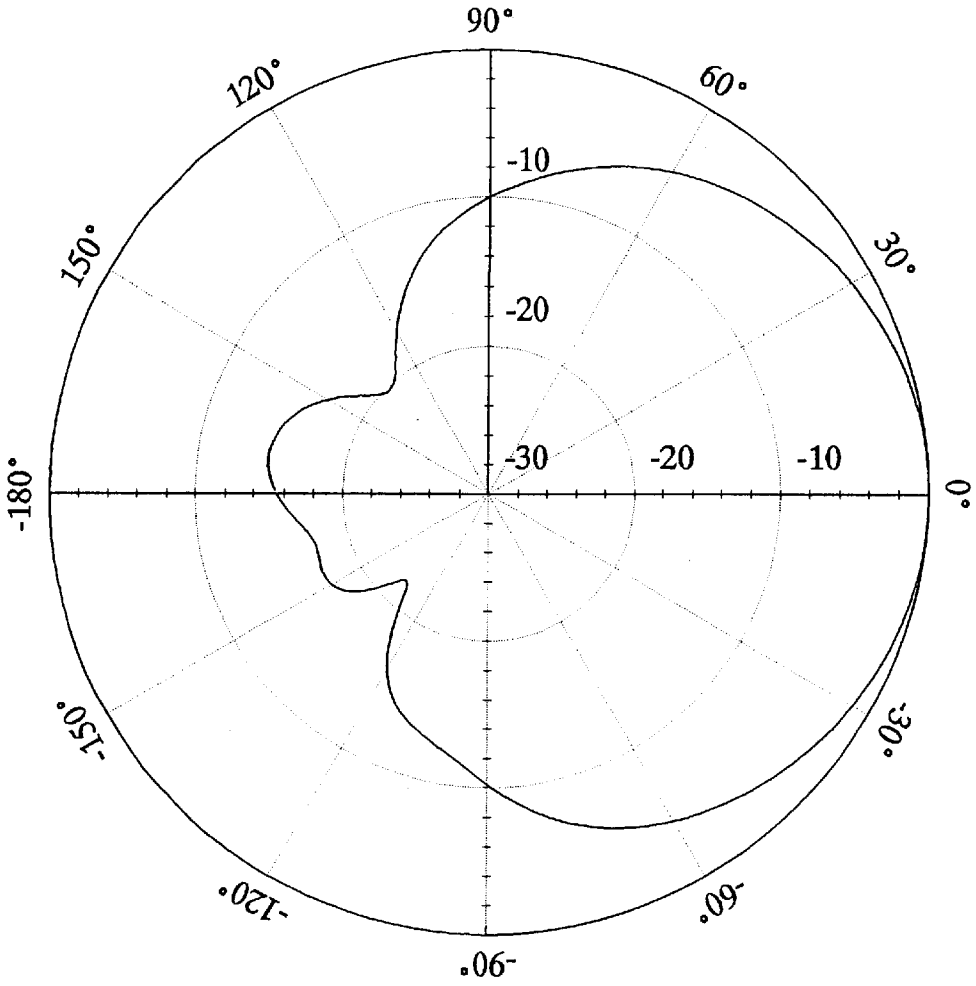
FIG. 4 shows the measured antenna pattern in 880 MHz according to the present invention.
Figure 5:
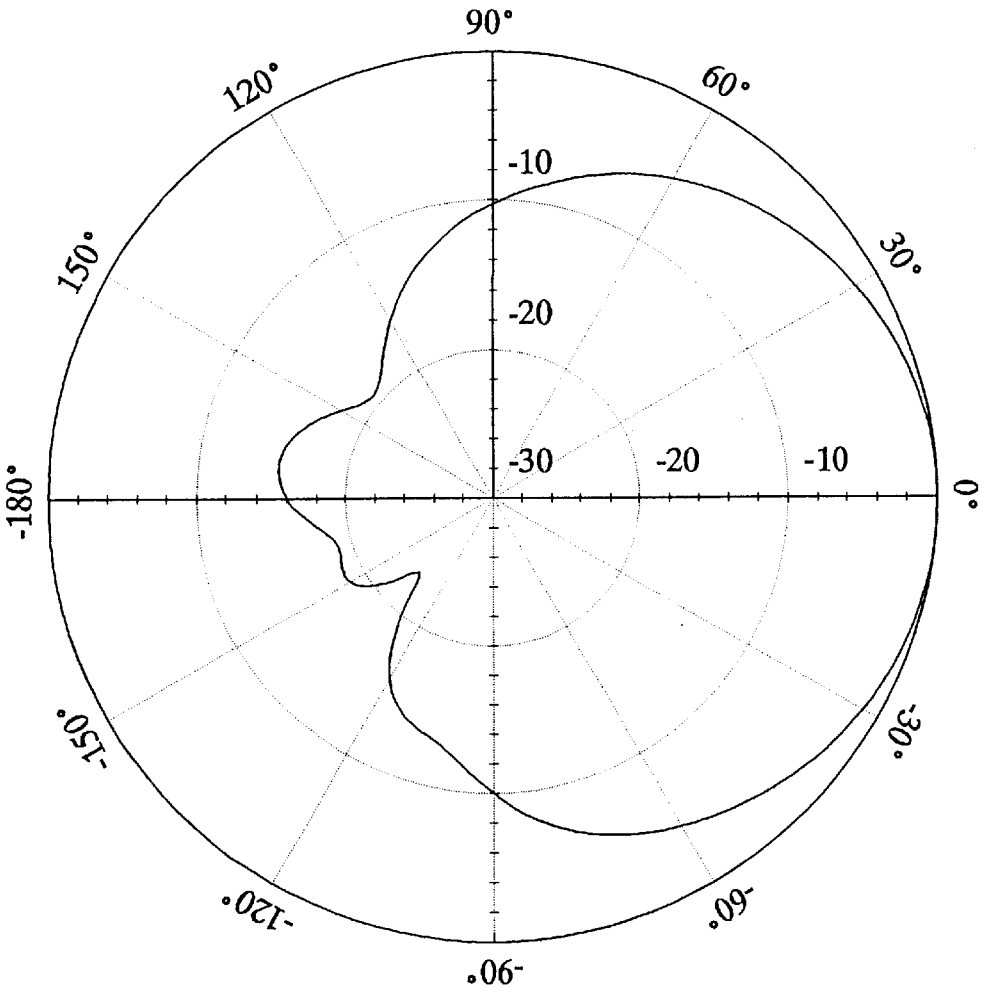
FIG. 5 shows the measured antenna pattern in 920 MHz according to the present invention.
Figure 6:
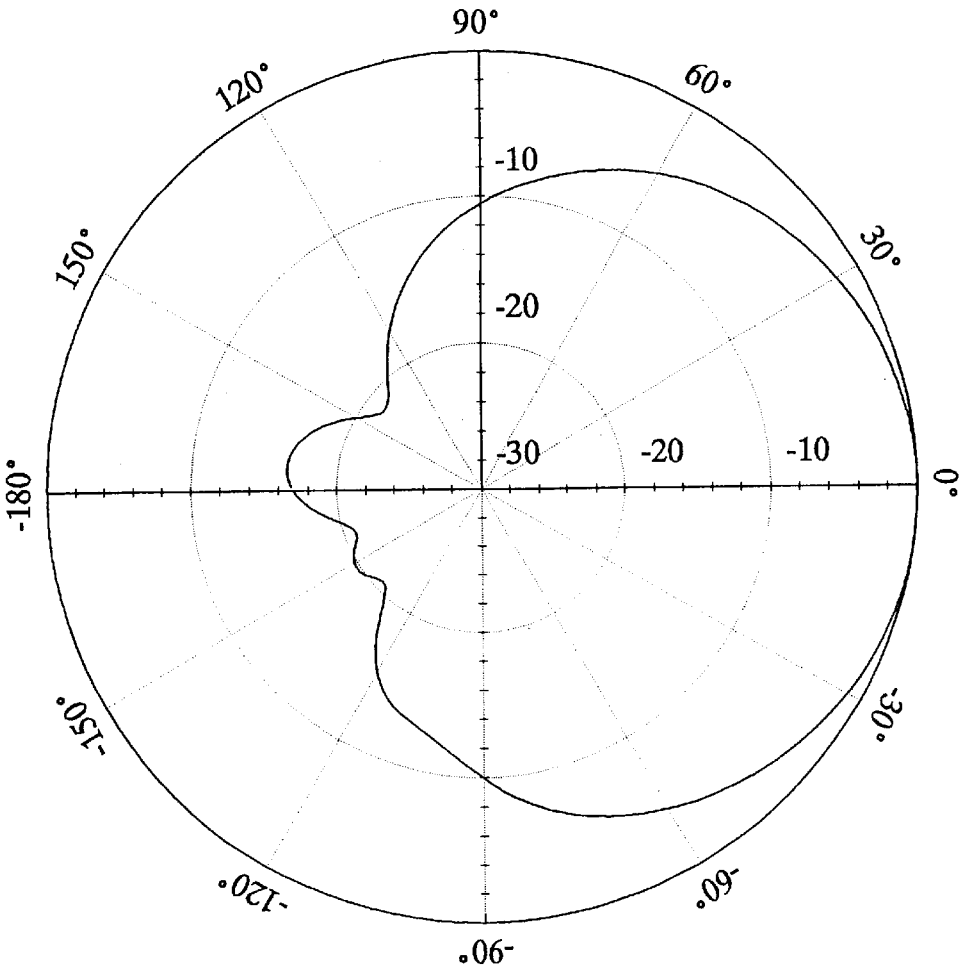
FIG. 6 shows the measured antenna pattern in 960 MHz according to the present invention.

Furthermore, FIGS. 4–6 disclose the measured antenna patterns of the present invention in different operating frequencies. FIG. 4 shows that the bandwidth of the measured −3dB is 92.94° and the antenna gain is 9.4dBi when the operating frequency is 880 MHz; FIG. 5 shows that the bandwidth of the measured −3dB is b 91.21° and the antenna gain is 9.04dBi when the operating frequency is 920 MHz; finally, FIG. 6 shows that the bandwidth of the measured −3dB is 92.47° and the antenna gain is 9.72dBi when the operating frequency is 960 MHz.

The antenna structure for communication according to the present invention can be used as an antenna for a base station so that the half-power beamwidth in the H-plane would be larger than 90° or above so as to widen the reception/transmission angle. This structure can be used not only as a communication antenna of the mobile phone, but also suitable for the radio communication system.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An antenna structure for communication, used in a base station of the radio communication system as a signal transceiver between the base station and several mobile terminals, comprising:

a slot coupled microstrip patch, which is connected to a signal source so as to radiate electromagnetic waves;

a reflector, which is attached to the back plane of the slot coupled microstrip patch in the manner of electrical isolation so that the backward radiated electromagnetic waves would be reflected forward;

an antenna combination, which is cascaded in front of the slot coupled microstrip patch in the manner of electrical isolation so as to increase the half-power beamwidth of the electromagnetic waves, also comprising:

a front-plate, which comprises a first flat plate, a second flat plate, and a curved plate used to connect the first flat plate and the second flat plate as the first flat plate and the second plate are placed in the same plane and electrically connected to the curved plate; and at least one patch, which is parallel to the first plate and the second plate and connected to the front-plate in the manner of electrical isolation, the area of each patch is the same as the projected area of the front-plate onto the patch so as to increase the radiation power of the electromagnetic waves.

2. The antenna structure for communication of claim 1 wherein the reflector is covered with a metal film.

3. The antenna structure for communication of claim 2 wherein the metal film is a copper film.

4. The antenna structure for communication of claim 1 wherein the reflector is a metal plate.

5. The antenna structure for communication of claim 4 wherein the reflector is made of aluminum.

6. The antenna structure for communication of claim 4 wherein the reflector is made of iron.

7. The antenna structure for communication of claim 1 wherein the first flat plate and the second flat plate belong to the same metal plate, and the front-plate is connected to this metal plate with a curved metal plate.

8. The antenna structure for communication of claim 1 wherein the shape of the curved plate is semicircle.

9. The antenna structure for communication of claim 1 wherein the front-plate and the patch are made of aluminum.

10. The antenna structure for communication of claim 1 wherein the front-plate and the patch are made of copper.

11. An antenna combination in an antenna structure for communication, which comprises a slot coupled microstrip patch for radiating electromagnetic waves and a reflector, the antenna combination is installed in front of the slot coupled microstrip patch in the manner of electrical isolation so as to increase the half-power beamwidth of the electromagnetic waves, comprising:

a front-plate, which comprises a first flat plate, a second flat plate, and a curved plate used to connect the first flat plate and the second flat plate together as the first flat plate and the second plate are placed in the same plane and electrically connected to the curved plate; and at least one patch, which is parallel to the first plate and the second plate and connected to the front-plate in the manner of electrical isolation, the area of each patch is the same as the projected area of the front-plate onto the patch so as to increase the radiation power of the electromagnetic waves.

12. The antenna combination of claim 11 wherein the first flat plate and the second flat plate belong to the same metal plate, and the front-plate is connected to this metal plate with a curved metal plate.

13. The antenna combination of claim 11 wherein the shape of the curved plate is semicircle.

14. The antenna combination of claim 11 wherein the front-plate and the patch are made of aluminum.

15. The antenna combination of claim 11 wherein the front-plate and the patch are made of copper.

* * * * *